US006503076B1

(12) United States Patent
Lauterbach

(10) Patent No.: US 6,503,076 B1
(45) Date of Patent: Jan. 7, 2003

(54) CIGARETTE LIGHTER

(76) Inventor: Sybille Lauterbach, Lortzingstrasse 30, D-97074 Würzburg (DE)

( * ) Notice: Subject to any disclaimer, the term of this patent is extended or adjusted under 35 U.S.C. 154(b) by 0 days.

(21) Appl. No.: 09/646,360

(22) PCT Filed: Oct. 31, 1998

(86) PCT No.: PCT/DE98/03188

§ 371 (c)(1),
(2), (4) Date: Oct. 16, 2000

(87) PCT Pub. No.: WO99/47857

PCT Pub. Date: Sep. 23, 1999

(30) Foreign Application Priority Data

Mar. 18, 1998 (DE) ..... 298 04 905 U

(51) Int. Cl.[7] ..... F23Q 2/32
(52) U.S. Cl. ..... 431/253; 431/255

(58) Field of Search ..... 431/253, 255, 431/277; 40/455, 906

(56) References Cited

U.S. PATENT DOCUMENTS 4,295,819 A * 10/1981 Sugiyama ..... 431/277
5,067,895 A * 11/1991 Chuang et al. ..... 431/253
5,228,848 A * 7/1993 Kim ..... 431/253
6,041,532 A * 3/2000 Pollhaus ..... 40/455

* cited by examiner

*Primary Examiner*—Sara Clarke
(74) *Attorney, Agent, or Firm*—Edwin D. Schindler

(57) ABSTRACT

A cigarette lighter, preferably, a disposable cigarette lighter, has a lighting device for producing a flame, and a noise generator. The noise generator cooperates with the lighting device, with the noise generator being activated upon actuation of the lighting device.

15 Claims, 2 Drawing Sheets

CIGARETTE LIGHTER

BACKGROUND OF THE INVENTION

1. Technical Field of the Invention

The invention relates to a cigarette lighter, especially a disposable cigarette lighter, with a lighting device for producing a flame.

2. Description of the Prior Art

Cigarette lighters are used to produce a flame to light, for example, a candle, a cigarette or a fire. In the state-of-the-art both disposable as well as reusable cigarette lighters are known, whereby with the latter the fuel, occasionally petrol, but usually a liquid gas such as butane or propane, can be refilled. When the lighting device is actuated, the gas that is used emerges from an adjustable nozzle and is ignited by a spark so that a flame is produced above the nozzle. The ignition spark is usually generated in a mechanical way, for instance, through the friction of a small ribbed steel wheel against a flint, of, for example, ferrocerium. The flint is pulverised and the fine, catapulted microcrystals are oxidised as the spark is produced. Moreover, lighting devices are known that are actuated electrically. To produce the ignition spark, they exploit, for example, the piezoelectric effect.

Because especially disposable cigarette lighters are very low priced and at least among smokers are a frequently used utensil, they are often and readily provided with a corresponding advertising imprint. Such cigarette lighters used as an advertising medium have the advantage that they are frequently used and can each time convey the imprinted advertising message to the user.

On the other hand, advertising novelties and toys are known which contain, for example, an electronically functioning noise generator, which, for example, in the case of a toy car, can produce a type of engine noise. The acoustic signals created by the noise generator have the task of surprising or amusing potential customers when viewing or using the advertising novelty, thus, in a psychologically skillful way directing their attention and interest toward the advertising novelty, including the advertising message conveyed by the novelty and in this way significantly improving the advertising effectiveness of the advertising novelty. In the case of toys, the noise created by the built-in noise generators are intended to increase the pleasure of play, improve its entertainment value and finally have the effect of promoting sales of the corresponding article.

However, in the state-of-the-art, no cigarette lighters are known which, during use, through the production of a special noise, contribute to the pleasure of the user, attract attention and which in an environment inundated by advertising stimuli can serve as an effective medium and conveyor of advertising messages.

SUMMARY OF THE INVENTION

Against this background, the present invention has the object of creating a cigarette lighter which distinguishes itself from conventional models during use through acoustic signals, which entertain its user, awaken the impression of dynamism and mobility and thereby generate sufficient attention for an effective conveyance of advertising messages.

In accordance with the invention, this task is solved therein that the cigarette lighter is equipped with a noise generator, the noise generator co-operates with the lighting unit and which is activated and generates noise upon actuation of the lighting unit.

The present invention is based on the idea that a cigarette lighter which generates unusual noises during use distinguishes itself significantly from conventional cigarette lighters, surprises its user and other people in the vicinity and contributes to their amusement. This holds especially when the noise is that of an engine of a motor vehicle, which, on the one hand, one does not expect from a cigarette lighter, which, however, on the other, in retrospect suggests itself in a certain way because both devices, the motor-vehicle engine and the cigarette lighter, are powered by liquid fuels as is known and where in particular petrol can be used for both. Moreover, many people combine such concepts as dynamism and mobility with a motor vehicle so that, for this reason, the engine noise from the cigarette lighter leads to positive associations. Overall, the inventive cigarette lighter is very well suited to both the use provided for of the production of flames as well as to entertain its user and can therefore also be advantageously used as an advertising medium. Then the noise generator creates advertising messages in form of advertising texts or melodies. To generate the engine noise, the invention proposes to equip the cigarette lighter with a noise generator which can create the engine noise of a motor vehicle and which co-operates with the lighting device of the cigarette lighter in such a way that is actuated when the lighting device is activated. Here, in the inventive sense, the term 'co-operates' means an interplay between the lighting device and the noise generator to the effect that the latter is actuated when the lighting device is activated. To that end, it is conceivable to provide a direct contact between the lighting device and the noise generator in the sense of a line, but also the case in which, without a direct connection, the noise generator is actuated immediately when the lighting device is activated. Such embodiments are explained in greater detail later as examples.

In particular, the engine noise which is created when the engine is started, and/or accelerated, reflects, in an unusual way, to a degree the processes inside the cigarette lighter when the flame is ignited and is therefore especially suitable for entertaining the user. Therefore, in a preferred inventive embodiment, a noise generator is used which creates this special type of noise.

In a further inventive development, the characteristic noise of a motor vehicle from motor sports can be used as engine noise, for example, the engine noise of a go-kart, of a formula-one racing car or also that of a saloon car used in rallycross. In this case, the inventive cigarette lighter is suitable for lending its user, or also the company advertising through the cigarette lighter, or the promoted product, an image of sporting prowess and modem innovative technology, characteristics which are generally associated with motor sport. Moreover, the possibility is offered of using such an embodied cigarette lighter as motor sport fan merchandise.

One obtains an especially realistic transfer of the processes occurring when a motor vehicle is started to the cigarette lighter, if a time delay is provided between the beginning of the noise generation and the actual production of the flame of at least about 2 seconds, which, supported by suitable acoustic signals from the noise generator, symbolizes the delay between the start of an engine and the acceleration from rest by the vehicle.

Conceivable as a noise generator for the inventive cigarette lighter is, for example, an electronic noise generator, which, due to its small dimensions, its insignificant weight and low price, is extremely suitable for integration in a cigarette lighter.

The special embodiment of the lighting device for producing the flame for the inventive lighter is largely optional in the frame of the inventive conception. Owing to its low price, however, especially a mechanical light device is conceivable, for example, which employs a flint and a ribbed steel wheel to produce the ignition spark. Of course, the use of an electric lighting device is also conceivable for the inventive lighter, which to produce the ignition spark exploits, for example, the piezoelectric effect.

In an especially preferred embodiment, the cigarette lighter is accommodated in a housing which is dimensioned so that the control knob of the lighting device is located outside the housing in same way as the flame to be produced. Thus it is still possible to actuate the lighter in spite of the housing and the flame can be produced without hindrance. The decisive innovation is the provision of a piezo-element between the housing and the base of the lighter and movement of the lighter relatively in respect of the housing—even if only by a small distance. With the described arrangement, the following physical processes occur when the lighting device is actuated. Through actuation of the lighting device and the simultaneous holding of the housing, a relative motion occurs between the lighter and housing, which compresses the piezo-element. This happens when the lighter is handled in the usual way, that is, the housing is held in four fingers of one hand and the lighting device is activated via the thumb. Thereby, at least one force component acts upon the lighter in the sense of pressing its base against the housing in the place where the piezo-element is disposed. The deformation of the piezo-element generates an electric signal which is used to activate the noise generator. A direct connection between the lighting device and the noise generator in the sense of a connection realised by a line is not necessary in this form of embodiment. The advantages consist therein that conventional cigarette lighters can be fitted into the housing without any adaptation or replaced. Then, too, a rigid connection between the housing and lighter in the form of a line is not necessary.

The noise generator, in its basic configuration, comprises a loudspeaker, the electronics, and a battery supplying energy. If a housing is used in the described way, two possibilities are preferred for the configuration of the noise generator. On the one hand, it can be disposed below the piezo-element and opposite the lighter in the housing, which results in a device whose cross-section perpendicular to the longitudinal axis is slightly larger than the cross-section of the cigarette lighter, however, in contrast, with a substantially extended axis.

In an alternative, the loudspeaker, the electronics and battery are disposed at the level of the lighter and next to the lighter in the housing. This largely retains the length of the cigarette lighter, however, the cross-section of the housing is substantially larger than that of the cigarette lighter.

Finally, the inventive cigarette lighter or the housing can be provided with an imprint on its exterior, which, for example, can comprise designs, images or texts. Therefore, an imprint can, on the one hand, be applied for design reasons to lend it the corresponding exterior appearance. It is, however, especially suitable for use as an advertisement, whereby the imprint can contain information about the advertising company or business or also about the promoted product itself.

BRIEF DESCRIPTION OF THE DRAWING FIGURES

Further details, features and advantages of the invention can be taken from the following description part in which with the aid of a drawing a typical embodiment of the invention is explained in greater detail.

DETAILED DESCRIPTION OF THE DRAWING AND PREFERRED EMBODIMENTS

Figure 1:
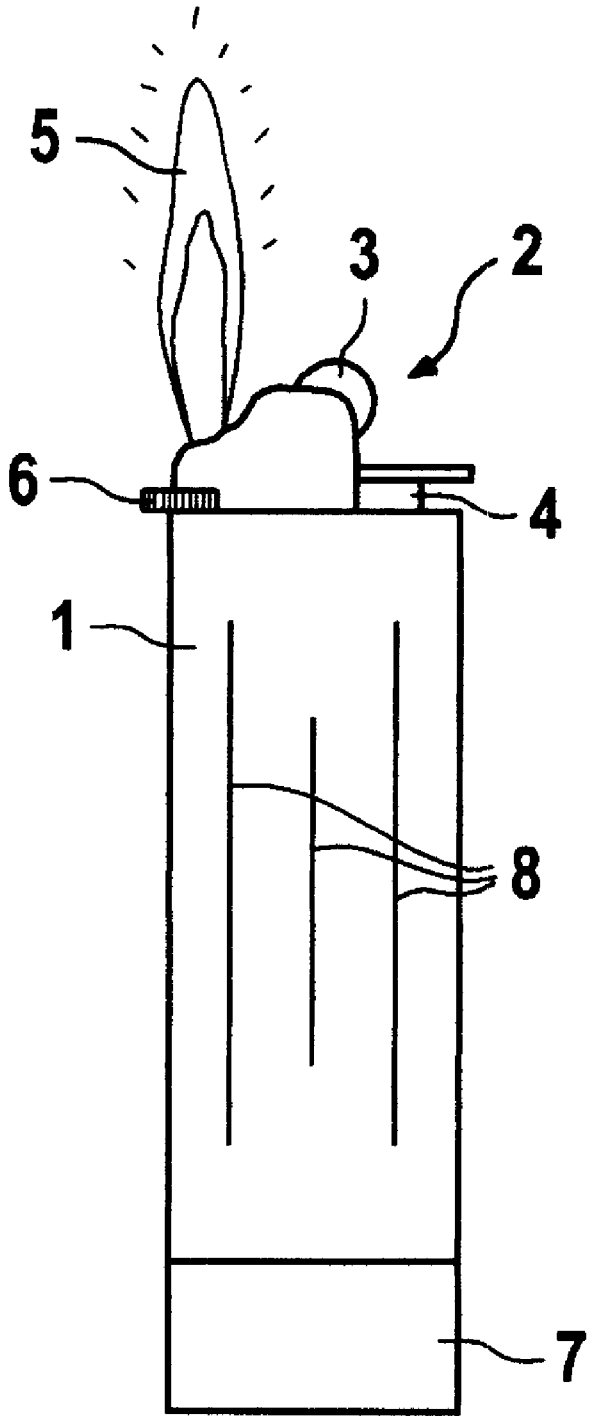
FIG. 1 shows a side view of an inventive cigarette lighter in a diagrammatic representation.

The inventive cigarette lighter shown in FIG. 1 comprises a storage container (1), which contains the fuel, for example, liquid butane, and a here in the example mechanical lighting unit (2), which generates the ignition spark through friction of the ribbed steel wheel (3) against a flint not shown here. This spark then ignites the gas which escapes from a nozzle when the valve (4) is opened, which then combusts in the flame (5). The flame size can be adjusted using the setting screw (6) to regulate the gas flow emitted through the nozzle. The noise generator (7) of the inventive cigarette lighter in the example is disposed below the storage container (1) and, when the lighting device (2) is actuated, it generates the noise of a starting formula-one racing car. Through the production of this noise, the inventive cigarette lighter astonishes and causes amusement for its user and other persons in listening distance, and in this way contributes to the dissemination of the advertising message contained in the imprint (8) on the exterior of the storage container (1) and draws associations with sporting prowess and technical innovation.

Figure 2:
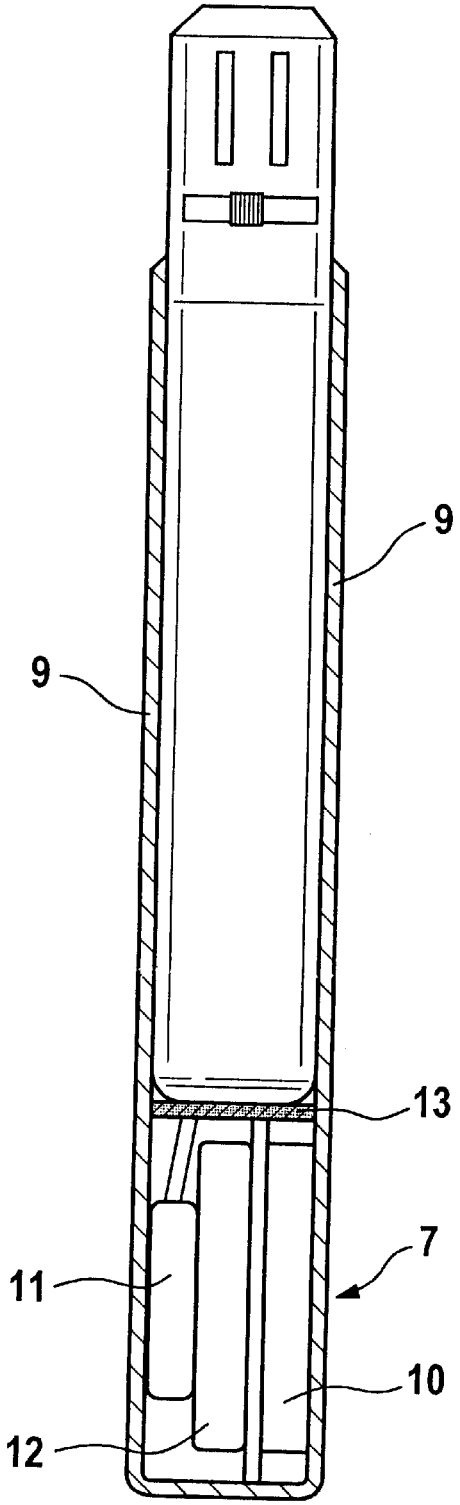
FIG. 2 shows a cigarette lighter in a housing, whereby the noise generator is disposed below the base of the cigarette lighter.

FIG. 2 shows, in an longitudinal section, a cigarette lighter disposed in a housing (9). The lighting device and the flame to be produced project beyond the housing (9) and jut outwards. Thus unhindered access to the lighting device and unhindered access to the flame to be produced is possible. Below the storage container, similar to FIG. 1, is disposed the noise generator (7), comprising a loudspeaker (10), the electronics (11) and the battery (12). The decisive difference, however, to FIG. 1 consists therein that the base plate of the storage container (1) fits against a piezo-element (13), with the result that when the lighting device (2) is actuated it is pressed against the element and an electric signal is generated which is used to trigger the noise generator. A relative motion between the housing (9) and the cigarette lighter is indispensable to that end. The cigarette lighters can be replaced without problem through removal from the housing (9) and replacement by a different cigarette lighter of the same dimensions.

Figure 3:
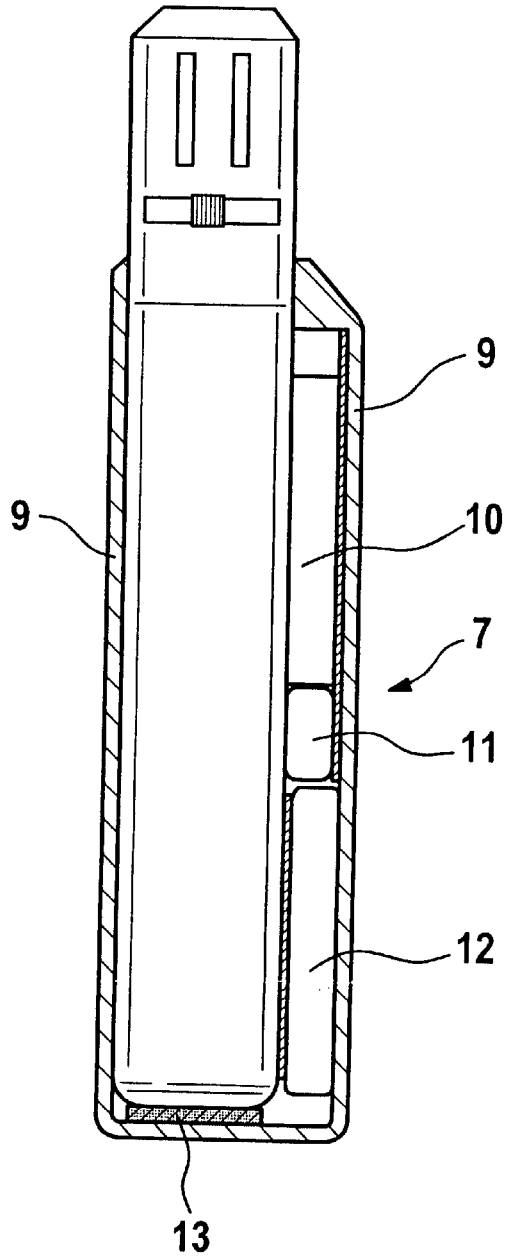
FIG. 3 shows a cigarette lighter with a housing with a noise generator next to the cigarette lighter.

In contrast, the device shown in FIG. 3 has a noise generator (7), also comprising a loudspeaker (10), the electronics (11) and a battery (12), which is disposed next to the housing (9).

The piezo-element on the other hand remains below the base of the cigarette lighter or its storage container (1). In contrast to the embodiment described in FIG. 2, one obtains an embodiment of less height but greater diameter. The replacement of the cigarette lighter is possible in the same unproblematic manner. Here, too, a direct material connection in the sense of a line is not necessary.

What is claimed is:

1. A cigarette lighter, comprising:

a lighting device with means for producing a flame;

a noise generator able to be activated by said lighting device for generating a noise when said lighting device is activated; and, means for providing a time delay between commencement of the noise and when said lighting device is activated for producing the flame.

2. The cigarette lighter according to claim 1, wherein said time delay between commencement of the noise and when said lighting device is activated for producing the flame is at least two seconds.

3. The cigarette lighter according to claim 1, wherein the noise generated by said noise generator is that of an engine of a motor vehicle.

4. The cigarette lighter according to claim 1, wherein the noise generated by said noise generator is that of an engine of a motorbike.

5. The cigarette lighter according to claim 1, wherein the noise generated by said noise generator is a melody.

6. The cigarette lighter according to claim 1, wherein the noise generated by said noise generator is a verbal announcement.

7. The cigarette lighter according to claim 1, wherein said lighting device is a piezoelectric lighting device.

8. The lighting device according to claim 1, further comprising:

a housing containing said lighting device and said noise generator, but allowing for the flame to be produced outside of said housing, said cigarette lighter being movable relative to said housing; and, a piezo-element disposed between said housing and a base of said lighting device which, when deformed, activates said noise generator.

9. A cigarette lighter, comprising:

a lighting device with means for producing a flame;

a noise generator able to be activated by said lighting device for generating a noise when said lighting device is activated;

a housing containing said lighting device and said noise generator, but allowing for the flame to be produced outside of said housing, said lighting device being movable relative to said housing; and, a piezo-element disposed between said housing and a base of said lighting device which, when deformed, activates said noise generator.

10. The cigarette lighter according to claim 9, wherein the noise generated by said noise generator is that of an engine of a motor vehicle.

11. The cigarette lighter according to claim 9, wherein the noise generated by said noise generator is that of an engine of a motorbike.

12. The cigarette lighter according to claim 9, wherein the noise generated by said noise generator is a melody.

13. The cigarette lighter according to claim 9, wherein the noise generated by said noise generator is a verbal announcement.

14. The cigarette lighter according to claim 9, further comprising means for providing a time delay between commencement of the noise and when said lighting device is activated for producing the flame of at least two seconds.

15. The cigarette lighter according to claim 9, wherein said lighting device is a piezoelectric lighting device.

* * * * *